United States Patent [19]

Adachi

[11] Patent Number: 4,519,595

[45] Date of Patent: May 28, 1985

[54] APPARATUS FOR UNWINDING FABRIC FROM A ROLL

[75] Inventor: Shoichi Adachi, Oosaka, Japan

[73] Assignee: N.C.A. Co., Ltd., Oosaka, Japan

[21] Appl. No.: 629,514

[22] Filed: Jul. 10, 1984

[51] Int. Cl.[3] ..... B65H 29/46

[52] U.S. Cl. ..... 270/31; 83/925 CC

[58] Field of Search ..... 270/31, 30; 83/925 CC

[56] References Cited

U.S. PATENT DOCUMENTS 4,177,980 12/1979 Melega ..... 270/31
4,381,859 5/1983 Jung et al. ..... 270/31
4,477,065 10/1984 Smith et al. ..... 270/31

FOREIGN PATENT DOCUMENTS 2023201 12/1979 United Kingdom ..... 270/31

*Primary Examiner*—E. H. Eickholt
*Attorney, Agent, or Firm*—Oblon, Fisher, Spivak, McClelland & Maier

[57] ABSTRACT

A fabric-unwinding apparatus, wherein a travelling, body can move back and forth over a work table. A fabric roll is supported on a support table mounted on the travelling body, and an unwinding roll is set on the support table in a manner to be contacted and driven with the fabric roll. The support table is made to be horizontally swung through 180° in both ways so as to take a first position where the unwinding roll lies in the forward part with respect to the fabric roll and a second position where the fabric roll lies in the forward part with respect to the unwinding roll. A fabric unfurled from its roll by the unwinding roll is suspended on a belt conveyer built below the unwinding roll and then transported by the belt conveyer to the forward part of the moving course of the travelling body. The transported fabric is set on the work table by the feed roll to be spread thereover. When the support table is horizontally swung through 180°, the front side of the fabric is kept upward instead of the backside thereof, thereby causing the front side of the cut pieces of the fabric placed on the work table to be kept upward instead of the backside thereof. The repetition of the horizontal 180° swing of the support table causes the cut pieces of the fabric to be superposed on each other on the work table in such a manner that the front and back sides of the cut pieces of the fabric are alternately kept upward.

17 Claims, 6 Drawing Figures

APPARATUS FOR UNWINDING FABRIC FROM A ROLL

BACKGROUND OF THE INVENTION

This invention relates to an apparatus for unwinding fabric from a roll with the desired plane kept upward.

Initially fabric just woven from a weaving machine is generally take up on a roll. Before the fabric is cut, therefore, it is necessary to unwind the fabric from a roll, and cut the fabric into a prescribed length to later be superposed or folded together. A fabric unwinder is used in carrying out the above-mentioned operations.

With the conventional fabric unwinder, a travelling body is reciprocatively set lengthwise on a rectangular work table. A fabric wound about a shaft is rotatably set on the travelling body. The forward portion of the travelling body is provided with a plurality of feed rolls spatially arranged in the moving direction. The feed rolls, rotated by a drive motor, unwind a fabric from the shaft to transport it on a work table. Therefore, the conventional fabric unwinder is accompained with the drawbacks that, when unwound from the shaft by the feed rolls, the fabric undergoes tension, and a thin fabric is subjected to horizontal creasing or elastic shrinkage or elongation and presents difficulties in being smoothly unwound. Further, when a roll of, for example, thick synthetic leather, wound about a shaft, has a large diameter, a relatively great force has to be applied in initiating the unwinding of said roll. Therefore, slips tend to take place between the leather and feed rolls, presenting difficulties in effecting the constant unwinding of said leather roll.

With the conventional fabric unwinder, it is necessary to draw out the leading end of a fabric from its roll, and fit it to the feed rolls. To remove the fabric roll from the fabric unwinder, it is necessary to separate the leading end of the fabric from the feed rolls and take up the fabric. Since the above-mentioned steps are manually taken, the conventional fabric underwinder has the drawback that the work efficiency is considerbly low.

Particularly when, with the conventional fabric unwinder, the front side and backside of the same fabric are superposed in an alternating relationship by swinging the roll shaft in opposite directions, the fabric unwinder causes the fabric to be taken off the feed rolls each time the fabric is cut. After the fabric is completely taken up on the shaft, the shaft is horizontally swung through 180° to reverse the front and back sides of the fabric, and the leading end of the fabric is fitted to the feed rolls. Therefore, the conventional fabric unwinder has the drawback that the above-mentioned operation steps consume a great deal of time.

SUMMARY OF THE INVENTION

It is accordingly the object of this invention to provide a fabric unwinder which enables a fabric to be smoothly unwound from a take up shaft at a prescribed speed regardless of the thickness of a fabric or the diameter of the roll wound about the shaft, to be superposed on the work table each other in such a manner that the front and back sides thereof are alternately kept upward, thereby ensuring the automatic quick unwinding of the fabric roll.

According to the present invention, there is provided an apparatus for unwinding a roll of a fabric taken up on a shaft which comprises:

a rectangular work table;

a travelling body mounted on the work table to be moved lengthwise back and forth;

a support table which is built on the travelling body and can be swung about an axis substantially perpendicular to the work table and which supports a fabric roll in such a manner that it can be rotated about its axis;

an unwinding roll rotatably supported on the support table so as to be contacted with the fabric roll; and feed means for forwarding the fabric unwound from its roll by means of the unwinding roll to the work table lying ahead of the travelling body, and wherein, when the travelling body runs backward and the unwinding roll is rotated, the fabric is unfurled from its roll, the feed means forwards the unwound fabric to the work table, and, when the support table is swung, the fabric is conveyed to the work table in such a manner that the front and back sides of the fabric are alternately kept upward.

To attain the above-mentioned object, this invention provides a fabric unwinder wherein a table for supporting a fabric roll shaft is so set as to swing horizontally through 180° in both ways; wherein a fabric unwound by an unwinding roll is successively moved forward by the fabric feeding means; wherein when, therefore the fabric are carried forward in such a manner that the front and back sides thereof are alternately kept upward, the object is attained simply by causing said support table to be swing horizontally through 180° in both ways; wherein the 180° horizontal swing of said support table is automatically carried out by a drive means connected to said support table; and wherein the operation of forwarding a fabric with its front and back sides alternately reversed can be automated with high efficiency.

DETAILED DESCRIPTION OF THE PREFERRED EMBODIMENTS

Figure 1:
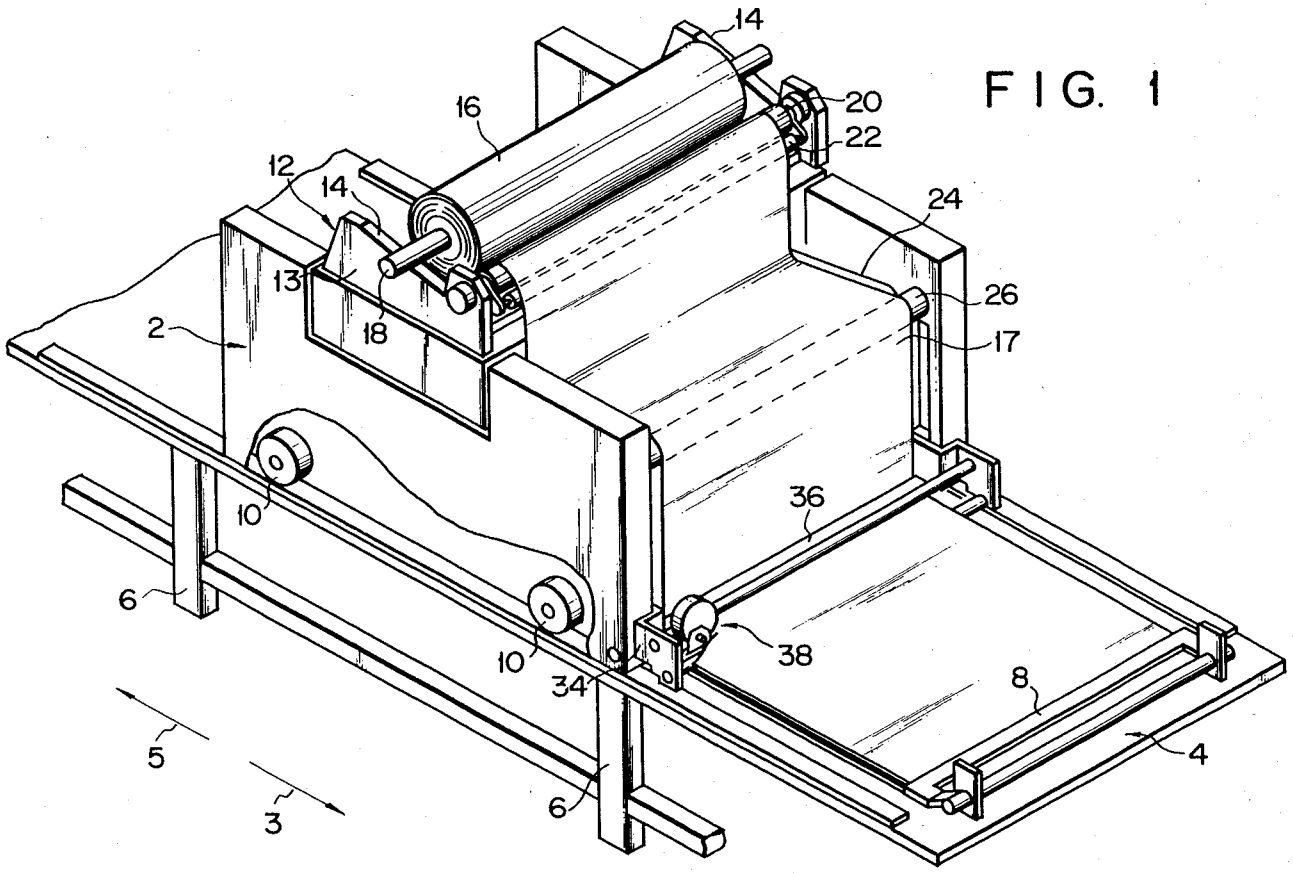
FIG. 1 is an oblique view of a fabric unwinder embodying this invention.

FIGS. 1 to 6 illustrate a fabric unwinder embodying this invention. A flat rectangular work table 4 is supported in a horizontal position by a plurality of support legs 6. A catcher 8 is mounted on the surface of the lengthwise front end portion of the work table 4. A traveling body 2 is mounted on the work table 4. The lower part of the travelling body 4 is fitted with travelling wheels 10. The travelling body 2 is reciprocally moved lengthwise of the work table 4 by the rotation of said travelling wheels 10 driven by a motor 5 in the directions of arrows 3 and 5. The travelling body 2 is provide with a support table 12 made rotatable by means of the later described rotation mechanism. A pair of support plates 13 are projectively provided on the support table 12 which are spaced from each other crosswise of the travelling body 2. The upper edge of the support plate 13 is provided with a tapered edge 14 inclined in the moving direction of the travelling body 2. Mounted on said tapered-edge 14 is a shaft 18 wound with a roll of fabric 16 by means of a proper bearing (not shown) set on said tapered edge 14. The fabric roll 16 is stretched between the support plates 13. The support table 12 is provided with a unwinding roll 20 whose end portions are positioned near the tapered edges 14. The roll shaft 18 is so urged as to move gravitationally along the tapered edge 14 toward the unwinding roll 20 by the total weight of the fabric roll and shaft, which is progressively reduced accordingly as the fabric is unwound.

Figure 2:
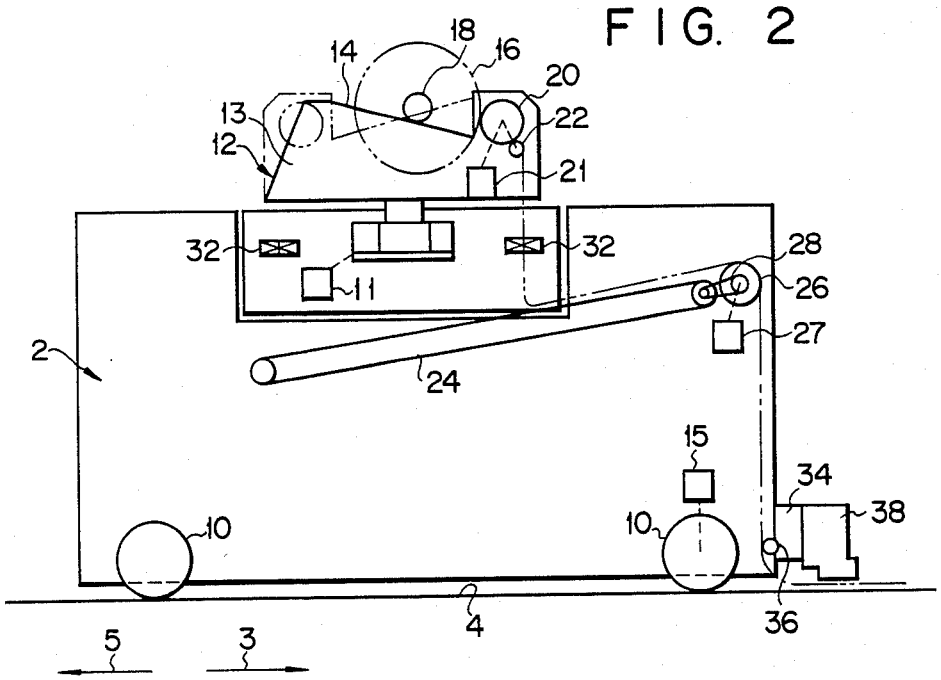
FIG. 2 is a front view of the fabric unwinder of FIG. 1.

The surface of the roll 20 is coated with a slipstop layer prepared from urethane rubber or felt, thereby preventing the fabric 17 from slipping. As shown in FIG. 2, the unwinding roll 20 is rotated by a motor 21 around an axis normal to the moving directions 3, 5 of the travelling body 2 so as to tumble over the fabric roll 16. Thus, the fabric 17 is unwound from the fabric roll 16 in the form of a sheet. An auxiliary roll 22 having a smaller diameter than the unwinding roll 20 is rotatably supported as later described (see FIGS. 4 to 6) below said unwinding roll 20. The fabric 17 unwound from the fabric roll 16 by the unwinding roll 20 is transported downward while being brought into contact with said auxiliary roll 22. A belt conveyer 24 is provided below the support table 12. This belt conveyer 24 is made to move in the same direction as the travelling body 2 and is stretched slightly upward. A feed roll 26 is rotatably supported by the travelling body 2 in the vicinity of the forward end portion of the belt conveyer 24 as viewed in its travelling direction. The feed roll 26 is driven by a motor 27 (FIG. 2). The feed roll 26 and belt conveyer 24 are coupled together by transmission means, for example, a chain. The belt conveyer 24 is moved interlockingly with the rotation of the feed roll 26.

A pair of optical sensors 32 for detecting the positions of the lateral edges of the fabric 17 are provided below the unwinding roll 20, and below the unwinding roll 20 after the support table 12 being rotated as later described (as indicated by a one dot-dash line in FIG. 2).

Upon receipt of an output signal from said paired optical sensors 32 the support table 12 is moved by a servo mechanism (not shown) perpendicularly to the running direction of the travelling body 2 (that is, the direction indicated by the arrows 3 and 5). As a result, the fabric 17 is moved crosswise thereby to adjust the positions of the lateral edges thereof.

The support table 12 is provided with an optical sensor (not shown) set below the unwinding roll 20 to detect the leading end of the fabric 17. When the support table 12 is horizontally swung through 180°, the fabric 17 is taken up on the shaft 18. When, in this case, the optical sensor detects the leading end of the fabric 17, that is, when the leading end of the fabric 17 is somewhat suspended from the unwinding roll 20, the take up of the fabric 17 is stopped.

Both laternal walls of the forward lower portion of the travelling body 2 are fitted with a vertically movable bracket 34. This vertically movable bracket 34 is operated by an elevator mechanism (not shown) built in the travelling body 2. A guide roll 36 and cutter unit 38 are fitted to said vertically movable bracket 34. The fabric 17 is lifted to a prescribed height above the work table 4 by the guide roll 36 and the bracket 34 to be cut to a prescribed length by the cutter unit 38.

Figure 4:
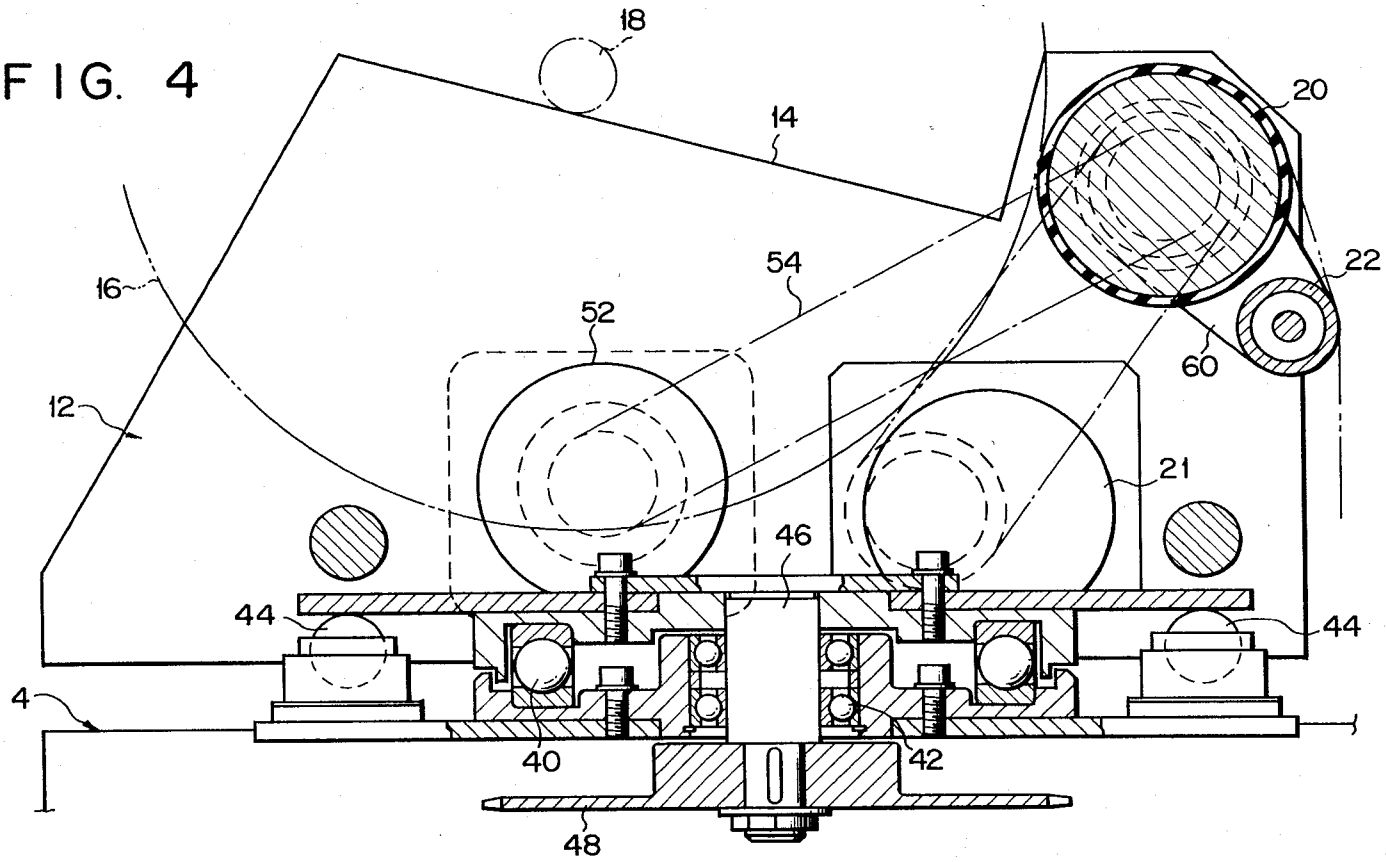
FIG. 4 is an enlarged sectional view of the support table of the fabric unwinder of FIG. 1.
Figure 6:
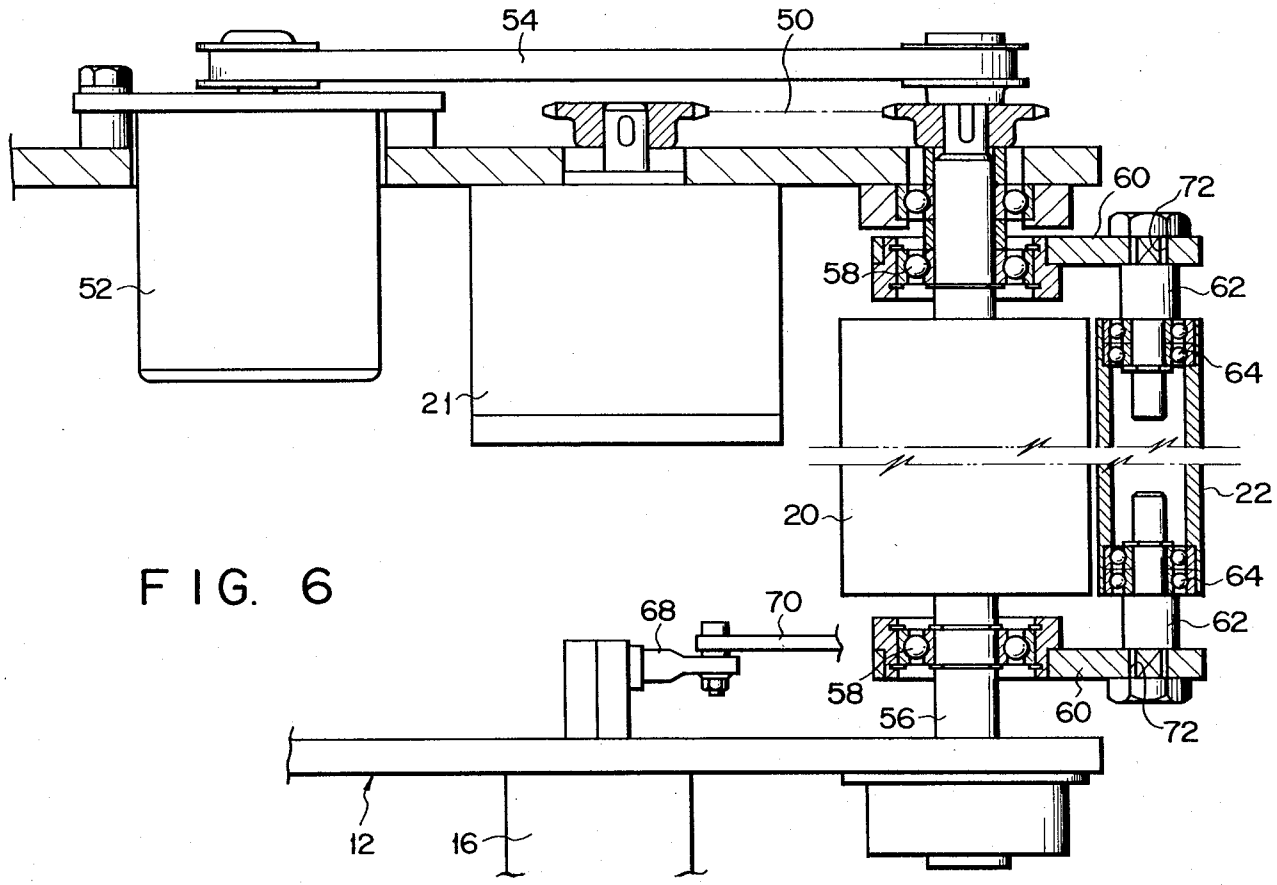
FIG. 6 is a plan view of the main part of the fabric unwinder of FIG. 1.

FIG. 4 is a detailed view of the horizontal rotation mechanism of the support table 12. Provided between the bottom of the support table 12 and the surface of the travelling body 2 are thrust bearings 40, ball bearings 44, and radial bearings 42. The horizontal rotation mechanism enables the support table 12 to be fitted to the movable body 2 so as to be rotated about a perpendicular axis. Provided below the support table 12 is a pivotal shaft 46 extending downward integrally with the support table 12. The pivotal shaft 46 is fitted with a sprocket 48. This sprocket 48 is rotated by the rotation mechanism consisting of, for example, a motor and chain. The sprocket rotation causes the support table 12 to be horizontally swung each time through 180° so as to take a first position where the unwinding roll 20 lies ahead of the arrow 3 with respect to the fabric roll 16 and also a second position where the fabric roll 16 lies ahead of the arrow 3 with respect to the unwinding roll 20. The unwinding roll 20 is driven interlockingly with the motor 21 by means of a chain 50 (FIG. 6). The rotary encoder 52 is driven interlockingly with the unwinding roll 20 by means of a timing belt 54 (FIG. 6) to record the number of the rotations of said unwinding roll 20.

Figure 5:
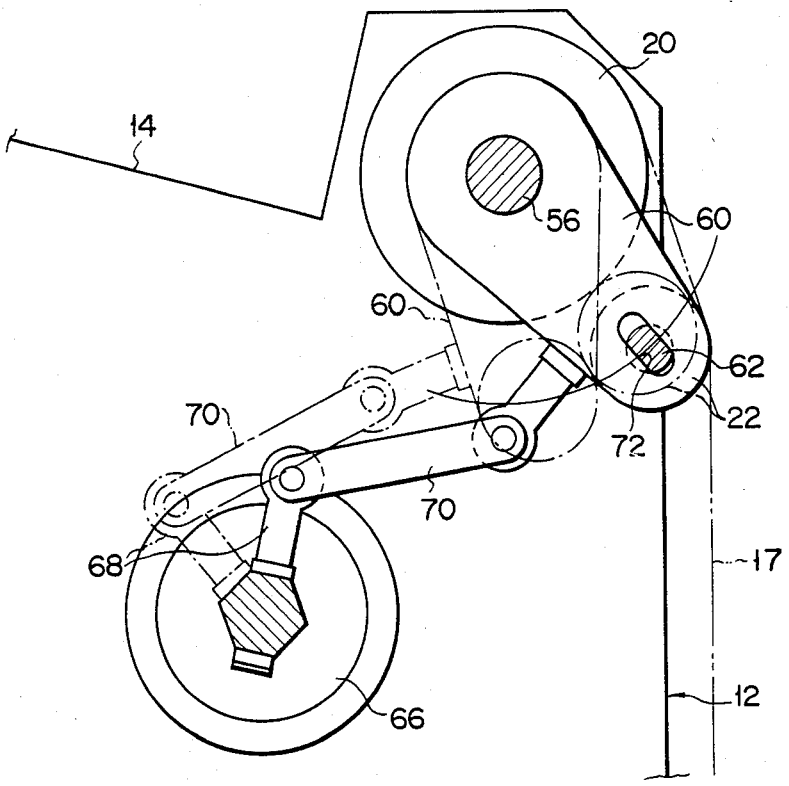
FIG. 5 is a front view showing the vicinity of an unwinding roll and an auxiliary unwinding roll of the fabric unwinder of FIG. 1.

FIGS. 5 and 6 show the manner in which the unwinding roll 20 and auxiliary roll 22 are rotatably coupled together. As seen from FIG. 6, the shaft 56 of the unwinding roll 20 is provided in the forward end portion of the support table 12. An arm 60 is rotatably fitted to said shaft 56 by means of a bearing 58. The shaft 62 of the auxiliary roll 22 is positioned in the forward end portion of the arm 60. The auxiliary roll 22 is rotatably supported by the roll shaft 62 by means of a bearing 64. As shown in FIG. 5, the auxiliary roll 22 revolves around the unwinding roll 20 by the rotation of the arm 60. As shown in FIG. 5, the arm 60 is coupled to the rod 68 of a rotary solenoid 66 mounted on the support table 12 by means of a connecting rod 70 in such a manner that both arm 60 and rod 68 can be jointly rotated. When, therefore, pushed to a position indicated by a solid line in FIG. 5, the auxiliary roll 22 is brought into contact with the fabric 17. When shifted to a position indicated by a dot-dash line, the auxiliary roll 22 is removed from the fabric 17. The auxiliary roll 22 is rotatably held due to its shaft 62 penetrating an elongated hole 72 extending lengthwise to the arm 60. When the shaft 62 is moved through the elongated hole 72, the auxiliary roll 22 is brought into contact with the unwinding roll 20, and rotated in the opposite direction to that of said unwinding roll 20. When, therefore, the drawn off fabric 17 is taken up on the shaft 18 and contacts both unwinding roll 20 and auxiliary roll 22, the fabric 17 undergoes some tension due to the rotations of the unwinding roll 20 and auxiliary roll 22 being in the opposite directions.

A description may now be made, with reference to the accompanying drawings, of the operation of taking off a fabric from the roll of a fabric-unwinding apparatus embodying the invention constructed as described above. The travelling body 2 is moved forwardly and its forward portion is brought near the catcher 8 (FIG. 1). The drive motors 21, 27 (FIG. 2) are jointly rotated to commence the operation of the unwinding roll 20, belt conveyer 24 and feed roll 26. At this time, the solenoid 66 (FIG. 5) is so energized as to cause the auxiliary roll 22 to take a position where it is prevented from contacting the fabric 17. The fabric roll 16 is rotated interlocking with the feed roll 26, causing the fabric 17 to be continuously drawn off. After taken up on part of the peripheral wall of the unwinding roll 20, the fabric 17 hangs downward on the underlying belt conveyer 24. The fabric 17 is carried forward by the belt conveyer 24 in the direction of the arrow 3. When the fabric 17 is unwound, that side of the fabric 17 which constitutes the inner wall of the fabric roll 16 is turned upward. The leading end of the fabric 17 is fixed to the work table 4 while being held by the catcher 8.

The drive motors 15, 21, 27 are jointly rotated to drive the travelling wheels 10, unwinding roll 20, belt conveyer 24 and feed roll 26 at the same time. The fabric 17 is successively unfurled from its roll 16 to be set on the work table 4 at a prescribed speed. Now, the travelling body 2 is carried backward in the direction of the arrow 5 at the same speed. Thus, the unfurled fabric 17 is spread over the work table 4.

After a prescribed length of the unfurled fabric 17 passed through the cutter unit 38, the motors 5, 21, 27 are brought to rest. At this time, the fabric 17 is cut off by the cutter unit 38. The vertically moving bracket 34 is lifted by an elevator, thereby causing the cutter unit 38 and final guide roll 36 to be raised to an extent corresponding to the thickness of the fabric 17. Thereafter, the travelling body 2 is carried forward in the direction of the arrow 3, thereby causing the forward portion of the travelling body 2 to be brought near the catcher 8. Thus, one cycle of cutting off the fabric 17 is brought to an end. After the cutting cycle is repeated, a plurality of cutpieces of the fabric 17 are superposed on each other on the work table 4 with the same plane kept upward.

A description is now given of the case where the cut pieces of the fabric 17 are superposed in such a manner that the front and back sides of said cut pieces are alternately kept upward. After the fabric is cut off by the cutter unit 38 and the vertically moving bracket 34 is lifted, the motor is reversely driven, thereby causing the unwinding roll 20 now to be rotated backward so as to take up the remaining uncut portion of the fabric 17 on the fabric roll 16. At this time, the solenoid 66 is energized to bring the auxiliary roll 22 into contact with the fabric 17. When the leading end of the remaining uncut fabric 17 is detected by the optical sensor positioned below the roll 20, the rotation of said roll 20 is stopped. Thereafter, the support table 12 is horizontally swung through 180° by the drive means 11 to take a position defined by the one dot-dash lines shown in FIG. 2. The roll 20 is rotated by the motor 21 to draw off the fabric 17 from its roll 16 and allows the fabric 17 to be suspended on the belt conveyer 24. The fabric 17 is carried forward in the direction of the arrow 3 by means of the belt conveyer 24 driven by the motor 27. In this case, the fabric 17 is placed on the belt conveyer 24 in such a manner that the plane of the fabric 17, which constitutes the outer wall of the fabric roll 16, is kept upward. In other words, the plane of the fabric 17, opposite to that which is kept upward when the support table 12 takes a position defined by the solid line in FIG. 2, is kept upward on the belt conveyer 24. Later, the same operation steps as described above ensue. Namely, the forward end of the fabric 17 is held by the catcher 8. The travelling body 2 recedes, and the fabric 17 is cut off to a prescribed length. Repetition of these operation steps causes the cut pieces of the fabric 17 to be superposed on each other in such a manner that the front and back sides of the cut pieces of the fabric 17 are alternately kept upward.

With the foregoing embodiment, the unwinding roll 20 and belt conveyer 24 are installed in the route through which the fabric 17 is carried from the fabric roll 16 to the feed roll 26. When, therefore, the position of the lateral edge of the fabric 17 is detected by the optical sensor 32, the support table 12 and fabric 17 can be smoothly moved in the crosswise direction thereof, while the fabric 17 passes over the unwinding roll 20 and belt conveyer 24. Since the roll 20, belt conveyer 24 and feed roll 26 are jointly driven, the fabric 17, even if it is thin, can be smoothly carried forward without undergoing tension, horizontal creasing, shrinkage or extension. Even when a roll of synthetic resin or jean fabric having a large diameter is unwound, the fabric unwinding apparatus of this invention suppresses the occurrence of slips between said fabric and feed means, enabling unwinding to be effected properly at a prescribed speed.

Further with the foregoing embodiment, when the fabric 17 is unwound, the auxiliary roll 22 touches the fabric 17, thereby eliminating the lengthwise creases of the fabric 17 due to the contact resistance of said touching auxiliary roll 22. Both upper edges of the support table 12 have a tapered plane 14 extending downward toward the unwinding roll 20, thereby enabling the fabric roll 16 to be always gravitationally brought into contact with the unwinding roll 20. Therefore, the fabric roll 16 rotated jointly with the unwinding roll 20, can be unfurled smoothly. Further, the fabric roll 16 can be easily set on the support table 12 simply by being mounted on the support plate 13. The fabric roll 16 can be automatically loaded on the subject fabric-unwinding apparatus by means of a proper transporting machine.

With the foregoing embodiment, the support table 12 on which the fabric roll 16 is rotatably mounted is supported on the travelling body 2 by means of a shaft, enabling the fabric to be unwound in the normal running direction of the travelling body 2 as well as in the opposite direction thereto. The unwinding roll 20 is mounted on the support table 12. When, therefore, the fabric roll 16 is horizontally swung through 180°, it is unnecessary to take up all the fabric 17 on the support shaft 18. In other words, the support table 12 can be horizontally swung through 180° with the leading end of the fabric 17 slightly suspended from the unwinding roll 20. The position of said leading end of the fabric 17 is detected by an optical sensor (not shown) installed below the support table 12. The take up of the fabric 17 is stopped when the leading end of the fabric 17 suspended from the unwinding roll 20 is detected by the optical sensor. Therefore, the fabric 17 whose leading end is pressed against the unwinding roll 20 can be automatically unfurled with ease. When the support table 12 is horizontally swung through 180° to take the position indicated by the one dot-dash line in FIG. 2, the fabric 17 is automatically conducted in the running direction of the travelling body 2 by means of the belt conveyer 24 built below the unwinding roll 20. When, therefore, the cut pieces of the fabric 17 are superposed on the work table 4 each other in such a manner that the front and back sides thereof are alternately kept upward, the support table 12 alone has to be horizontally swung through 180°, hereby ensuring the automatic quick unwinding of the fabric roll 16.

When the support table 12 is horizontally swung, a certain amount of the fabric 17 has to be properly taken up on the support shaft 18 by the reverse rotation of the unwinding roll 20 without giving rise to lengthwise creasing of the fabric 17. In this case, the fabric unwinding apparatus according to the above-mentioned embodiment of this invention offers the advantages that the auxiliary roll 22 is interlocked with the unwinding roll 20 in contact with the fabric 17; the fabric 17 undergoes some tension while passing over the unwinding roll 20 and the reversely rotated auxiliary roll 22, thereby being saved from the lengthwise creasing which might otherwise take place; the fabric 17 can be taken up on the shaft 18 in the properly rolled state; the cut pieces of the fabric 17 can be smoothly superposed on each other in such a manner that the front and back sides of said cut pieces are alternately kept upward; and after a certain unwound portion of the fabric roll 16 is cut up on a prescribed length and later superposed on each other in the aforementioned manner, the remaining portion of the fabric roll 16 can be taken off the support table 12 exactly in the originally rolled state.

As mentioned above, the fabric unwinding apparatus of this invention comprises the support table 16 which can be horizontally swung through 180°. This 180° horizontal rotation of the support table 16 enables the fabric to be carried to the belt conveyer 24 automatically and efficiently in such a manner that the front and backsides of the fabric are alternately kept upward.

Figure 3:
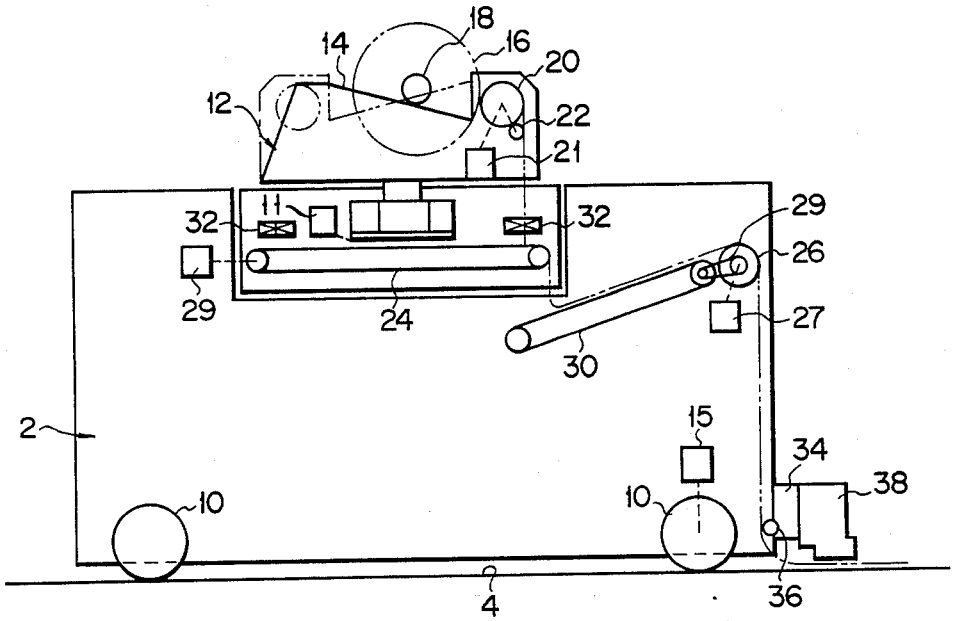
FIG. 3 is a front view of a modification of the fabric unwinder of FIG. 1.

A description may now be made with reference to FIG. 3 of a modification of the subject fabric unwinding apparatus. According to this modification, a belt conveyer 24 is driven by an independent motor 29. An auxiliary belt converyor 30 is interposed between said belt conveyer 24 and feed roll 26. The interlocking feed roll 26 and auxiliary belt conveyer 30 are driven by a transmission means 29 in a chain like manner. When the interlocking condition is stopped by a changeover means like an electromagentic clutch, the auxiliary belt conveyer 30 is rotated independently. With the above-mentioned modification of FIG. 3, the fabric 17 unfurled by the unwinding roll 20 is carried on the belt conveyer 24, which in turn transports the fabric 17 to the auxiliary belt conveyer 30. The fabric 17 brought to the auxiliary conveyer 30 is forward to a feed roll 26 to be delivered to the work table 4. An interlocking auxiliary belt conveyer 30, provided between the belt conveyer 24 and feed roll 26, is driven with the feed roll 26. The auxiliary belt conveyer 30 can be driven independent of the feed roll 26 by a changeover means. Normally, the fabric 17 is transported without undergoing a tension as previously described. When the above-mentioned modification handles a fabric having a tendency to be naturally rolled up, such as a hard synthetic leather, the interlocking condition between the feed roll 26 and auxiliary belt conveyer 30 is cut off to let said auxiliary belt conveyer 30 be independently driven. As a result, the feed roll 26 imparts some tension to the fabric 17 by the contact resistance of the auxiliary belt conveyer 30, thereby eliminating the crosswise creasing of the fabric 16.

What is claimed is:

1. An apparatus for unwinding a roll of a fabric taken up on a shaft which comprises:

a rectangular work table;

a travelling body mounted on the work table to be moved lengthwise back and forth;

a support table which is built on the travelling body and can be swung about an axis substantially perpendicular to the work table and which supports a fabric roll in such a manner that it can be rotated about its axis;

an unwinding roll rotatably supported on the support table so as to be contacted with the fabric roll; and feed means for forwarding the fabric unwound from its roll by means of the unwinding roll to the work table lying ahead of the travelling body, and wherein, when the travelling body runs backward and the unwinding roll is rotated, the fabric is unfurled from its roll, the feed means forwards the unwound fabric to the work table, and, when the support table is swung, the fabric is conveyed to the work table in such a manner that the front and back sides of the fabric are alternately kept upward.

2. The fabric-unwinding apparatus according to claim 1, which further comprises:

an auxiliary unwinding roll which is mounted on the support table to be driven with the unwinding roll and kept contact with the fabric to impart a tension thereto.

3. The fabric-unwinding apparatus according to claim 2, wherein the support table comprises a pair of support boards spatially erected in the crosswise direction of the travelling body, the upper edge of the support board is inclined toward the unwinding roll, the shaft of the unwinding roll is mounted on the inclined edges of both erected support boards, the fabric roll gravitationally slides downward along the inclined edges of said support boards to be brought into contact with the unwinding roll, and the interlocking rotation of the unwinding roll with the fabric roll effects the unwinding of the fabric.

4. The fabric-unwinding apparatus according to claim 2, which further comprises a coupling arm which enables the auxiliary unwinding roll to be driven with the unwinding roll or separated therefrom.

5. The fabric-unwinding apparatus according to claim 4, which further comprises a rotary solenoid which is coupled to the auxiliary unwinding roll to effect to be contacted with the unwinding roll.

6. The fabric-unwinding apparatus according to claim 1, which further comprises a pair of sensors which are set below the support table to detect the lateral edges of the fabric unfurled by the unwinding roll, and means for adjusting the position of the lateral edges of the unfurled fabric by detection signals issued from the paired sensors.

7. The fabric-unwinding apparatus according to claim 6, wherein said fabric edge-adjusting means causes the support table to run crosswise of the travelling body to effect the adjustment of the position of the lateral edges of the fabric.

8. The fabric-unwinding apparatus according to claim 1, wherein said feed means comprises a feed roll rotatably supported on the front upper portion of the travelling body, and the fabric unfurled by the unwinding roll is smoothly conducted to the work table by the rotation of the feed roll.

9. The fabric-unwinding apparatus according to claim 8, wherein the feed means comprises a belt conveyer built below the support table, and the fabric unfurled by the unwinding roll is suspended from the belt conveyer to be later transported to the feed roll by said belt conveyer.

10. The fabric-unwinding apparatus according to claim 9, wherein the travelling body comprises a cutter unit built at the front lower part of the travelling body, and the fabric spread over the work table is cut off by said cutter unit.

11. The fabric-unwinding apparatus according to claim 10, wherein the travelling body comprises a guide roll fitted to the front lower part of the travelling body, and the fabric drawn off from the feed roll is carried to the work table through the guide roll.

12. The fabric-unwinding apparatus according to claim 11, wherein the travelling body comprises a vertically moving bracket fitted to both corners of the front lower part of the travelling body, said bracket is provided with the guide roll and the cutter unit, operating an elevator connected to the bracket, thereby lifting the bracket to a prescribed height above the work table, and the fabric unfurled from the fabric roll are superposed on the cut pieces of the fabric previously set on the work table.

13. The fabric-unwinding apparatus according to claim 12, wherein the work table comprises a catcher built in the front part of the work table; and the fabric transported on the work table are securely set in place by said catcher.

14. The fabric-unwinding apparatus according to claim 9, wherein the belt conveyer comprises a belt whose surface is subjected to a slip-stop treatment.

15. The fabric-unwinding apparatus according to claim 3, wherein the surface of the unwinding roll is coated with a layer of urethane rubber or felt to stop the slippage of the unwinding roll.

16. The fabric-unwinding apparatus according to claim 9, which further comprises an auxiliary belt conveyer built between the belt conveyer and feed roll; the fabric unfurled from its roll by the unwinding roll is suspended over the belt conveyer to be carried forward by the belt conveyer, conducted to move from the forward end of the belt conveyer to said auxiliary belt conveyer, and further conducted to the feed roll by said auxiliary belt conveyer.

17. The fabric-unwinding apparatus according to claim 16, which further comprises interlocking means for causing the auxiliary belt conveyer to be driven with the feed roll, and separating means for stopping said interlocking drive.

* * * * *